US006626381B2

(12) United States Patent
Parrish

(10) Patent No.: US 6,626,381 B2
(45) Date of Patent: Sep. 30, 2003

(54) MULTI-PORT FUEL INJECTION NOZZLE AND SYSTEM AND METHOD INCORPORATING SAME

(75) Inventor: Scott E. Parrish, Farmington Hills, MI (US)

(73) Assignee: Bombardier Motor Corporation of America, Grant, FL (US)

( * ) Notice: Subject to any disclaimer, the term of this patent is extended or adjusted under 35 U.S.C. 154(b) by 27 days.

(21) Appl. No.: 10/005,865

(22) Filed: Nov. 8, 2001

(65) Prior Publication Data

US 2003/0084883 A1 May 8, 2003

(51) Int. Cl.[7] ..... F02M 61/00
(52) U.S. Cl. ..... 239/533.7; 239/533.12
(58) Field of Search ..... 239/533.1, 533.2, 239/533.3, 533.7, 533.8, 533.11, 533.12, 585.1, 585.3, 585.5, 585.4, 584, 5, 590, 590.5, 594, 595, 597, 601

(56) References Cited

U.S. PATENT DOCUMENTS

| | | | | | |
|---|---|---|---|---|---|
| 1,693,931 | A | * | 12/1928 | Lowe | 239/533.7 |
| 5,282,577 | A | * | 2/1994 | Neitz | 239/533.7 |
| 5,449,114 | A | | 9/1995 | Wells et al. | 239/5 |
| 5,522,550 | A | * | 6/1996 | Potz et al. | 239/533.9 |
| 6,155,499 | A | * | 12/2000 | Rembold et al. | 239/533.12 |
| 6,224,001 | B1 | * | 5/2001 | Cooke et al. | 239/533.12 |
| 6,340,017 | B1 | * | 1/2002 | Dick | 239/533.7 |

* cited by examiner

*Primary Examiner*—Thomas N. Moulis
(74) *Attorney, Agent, or Firm*—Ziolkowski Patent Solutions Group, LLC

(57) ABSTRACT

A technique is provided for enhancing fluid flow in an outwardly opening nozzle assembly. A flow enhancement assembly is provided adjacent an exit from an outwardly opening poppet to provide desired spray characteristics. The flow enhancement assembly includes converging and diverging passages and a plurality of ports to form a spray.

66 Claims, 8 Drawing Sheets

93
92
91
89
83g
83f
80
83b
84
90
88
82
83c
85
94
95
66
48
83a
83d
83e
81
86
87
97
99
EC1
EC2
74
MICRO-
PROCESSOR
DRIVER
CIRCUIT
EC3
EC4
EEPROM
98
96
20

MULTI-PORT FUEL INJECTION NOZZLE AND SYSTEM AND METHOD INCORPORATING SAME

BACKGROUND OF THE INVENTION

1. Field of the Invention

The present invention relates generally to the field of internal combustion engine injection systems. More particularly, the invention relates to a technique for controlling fluid flow and spray characteristics of a spray assembly by providing a flow enhancement assembly near the exit of an outwardly opening poppet.

2. Description of the Related Art

In fuel-injected engines, it is generally considered desirable that each injector delivers approximately the same quantity of fuel in approximately the same temporal relationship to the engine for proper operation. It is also well known that the fuel-air mixture affects the combustion process and the formation of pollutants, such as Sulfur Oxides, Nitrogen Oxides, Hydrocarbons, and particulate matter. Although combustion engines utilize a variety of mixing techniques to improve the fuel-air mixture, many combustion engines rely heavily on spray assemblies to disperse fuel throughout a combustion chamber. These spray assemblies may produce a variety of spray patterns, such as a hollow or solid conical spray pattern, which affect the overall fuel-air mixture in the combustion chamber. It is generally desirable to provide a uniform fuel-air mixture to optimize the combustion process and to eliminate pollutants. However, conventional combustion engines continue to operate inefficiently and produce pollutants due to poor fuel-air mixing in the combustion chamber.

Accordingly, the present technique provides various unique features to overcome the disadvantages of existing spray systems and to improve the fuel-air mixture in combustion engines. In particular, unique features are provided to enhance the fluid flow through an outwardly opening nozzle assembly to provide desired spray characteristics.

SUMMARY OF THE INVENTION

The present technique offers a design for internal combustion engines which contemplates such needs. The technique is applicable to a variety of fuel injection systems, and is particularly well suited to pressure pulsed designs, in which fuel is pressurized for injection into a combustion chamber by a reciprocating electric motor and pump. However, other injection system types may benefit from the technique described herein, including those in which fuel and air are admitted into a combustion chamber in mixture. Accordingly, a technique is provided for enhancing fluid flow in an outwardly opening nozzle assembly. A flow enhancement assembly is provided adjacent an exit from an outwardly opening poppet to provide desired spray characteristics. The flow enhancement assembly includes converging and diverging passages and a plurality of ports to form a spray.

In one aspect, the present technique provides a nozzle comprising an outwardly opening poppet disposed in a conduit and a spray formation assembly disposed adjacent a forward portion of the conduit. The outwardly opening poppet includes a fluid passage section and a head section removably seated against the forward portion. The spray formation assembly includes a flow enhancement passage comprising a contracting passage and an expanding passage.

The spray formation assembly also has a plurality of ports coupled to the flow enhancement passage.

In another aspect, the present technique provides a combustion engine comprising a combustion chamber, an ignition assembly coupled to the combustion chamber, a spray assembly coupled to the combustion chamber, and a fuel delivery assembly coupled to the spray assembly. The spray assembly includes an outwardly opening flow controller disposed in a conduit and a forward flow assembly disposed adjacent the outwardly opening flow controller. In this embodiment, the forward flow assembly has converging and diverging passages.

In another aspect, the present technique provides a method for forming a spray from an outwardly opening nozzle assembly. The method comprises passing fluid through a flow enhancement assembly forward an outwardly opening poppet disposed in a fluid conduit. The flow enhancement assembly includes converging and diverging passages having a ring-shaped cross-section. The method also comprises passing the fluid through a plurality of ports coupled to the flow enhancement assembly.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
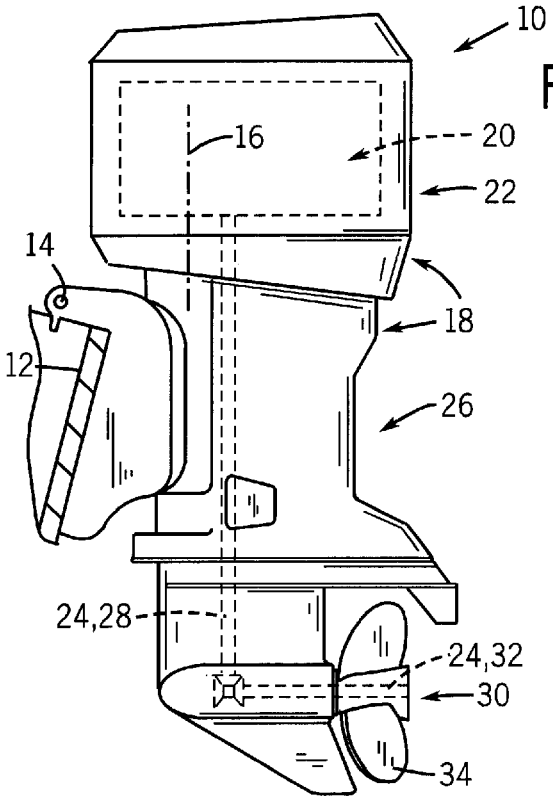
FIG. 1 is a side view of a marine propulsion device embodying an outboard drive or propulsion unit adapted for mounting to a transom of a watercraft.
Figure 2:
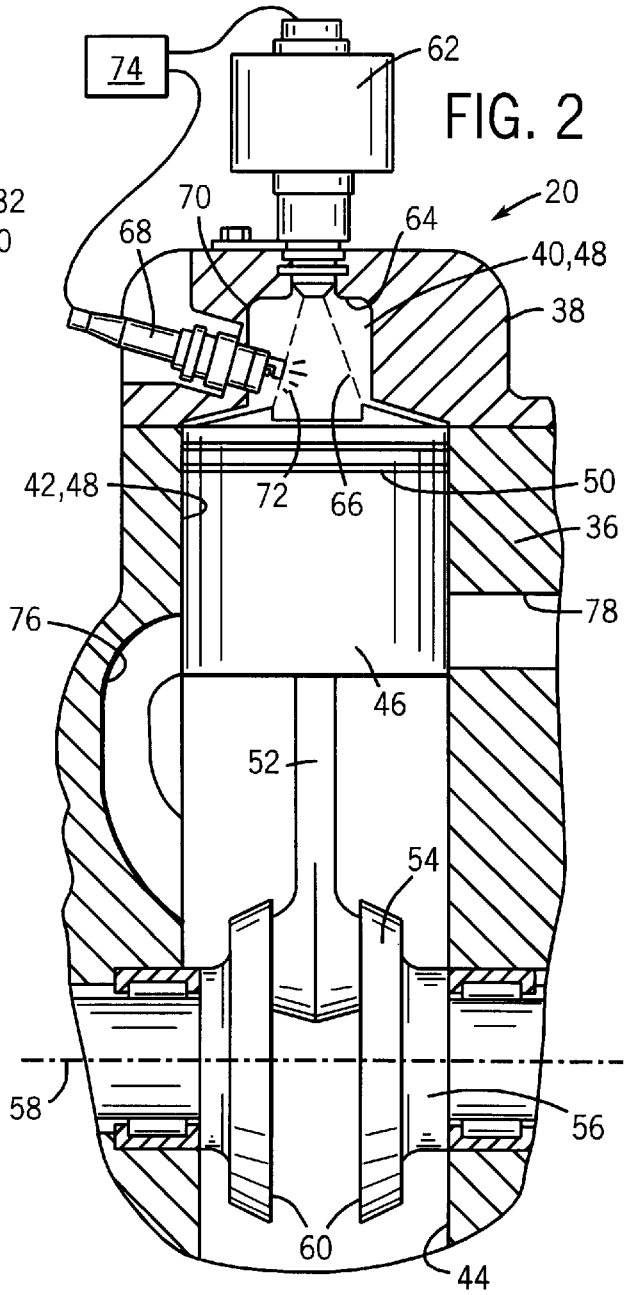
FIG. 2 is a cross-sectional view of the combustion engine.

The present technique will be described with respect to a 2-cycle outboard marine engine as illustrated in FIGS. 1–2. However, it will be appreciated that this invention is equally applicable for use with a 4-cycle engine, a diesel engine, or any other type of internal combustion engine having at least one fuel injector, which may have one or more geometrically varying fluid passageways leading to a nozzle exit. The present technique is also applicable in other applications utilizing fluid spray assemblies, such as a nozzle producing a hollow or solid cone-shaped droplet spray.

FIG. 1 is a side view of a marine propulsion device embodying an outboard drive or propulsion unit 10 adapted to be mounted on a transom 12 of a watercraft for pivotal tilting movement about a generally horizontal tilt axis 14 and for pivotal steering movement about a generally upright steering axis 16. The drive or propulsion unit 10 has a housing 18, wherein a fuel-injected, two-stroke internal combustion engine 20 is disposed in an upper section 22 and a transmission assembly 24 is disposed in a lower section 26. The transmission assembly 24 has a drive shaft 28 drivingly coupled to the combustion engine 20, and extending longitudinally through the lower section 26 to a propulsion region 30 whereat the drive shaft 28 is drivingly coupled to a propeller shaft 32. Finally, the propeller shaft 32 is drivingly coupled to a prop 34 for rotating the prop 34, thereby creating a thrust force in a body of water. In the present technique, the combustion engine 20 may embody a four-cylinder or six-cylinder V-type engine for marine applications, or it may embody a variety of other combustion engines with a suitable design for a desired application, such as automotive, industrial, etc.

FIG. 2 is a cross-sectional view of the combustion engine 20. For illustration purposes, the combustion engine 20 is illustrated as a two-stroke, direct-injected, internal combustion engine having a single piston and cylinder. As illustrated, the combustion engine 20 has an engine block 36 and a head 38 coupled together and defining a firing chamber 40 in the head 38, a piston cylinder 42 in the engine block 36 adjacent to the firing chamber 40, and a crankcase chamber 44 in the engine block 36 adjacent to the piston cylinder 42. A piston 46 is slidably disposed in the piston cylinder 42, and defines a combustion chamber 48 adjacent to the firing chamber 40. A ring 50 is disposed about the piston 46 for providing a sealing force between the piston 46 and the piston cylinder 42. A connecting rod 52 is pivotally coupled to the piston 46 on a side opposite from the combustion chamber 48, and the connecting rod 52 is also pivotally coupled to an outer portion 54 of a crankshaft 56 for rotating the crankshaft 56 about an axis 58. The crankshaft 56 is rotatably coupled to the crankcase chamber 44, and preferably has counterweights 60 opposite from the outer portion 54 with respect to the axis 58.

In general, an internal combustion engine such as engine 20 operates by compressing and igniting a fuel-air mixture. In some combustion engines, fuel is injected into an air intake manifold, and then the fuel-air mixture is injected into the firing chamber for compression and ignition. As described below, the illustrated embodiment intakes only the air, followed by direct fuel injection and then ignition in the firing chamber.

A fuel injection system, having a fuel injector 62 disposed in a first portion 64 of the head 38, is provided for directly injecting a fuel spray 66 into the firing chamber 40. An ignition assembly, having a spark plug 68 disposed in a second portion 70 of the head 38, is provided for creating a spark 72 to ignite the fuel-air mixture compressed within the firing chamber 40. The control and timing of the fuel injector 62 and the spark plug 68 are critical to the performance of the combustion engine 20. Accordingly, the fuel injection system and the ignition assembly are coupled to a control assembly 74. As discussed in further detail below, the uniformity of the fuel spray 66 is also critical to performance of the combustion engine 20. The distribution of fuel spray 66 affects the combustion process, the formation of pollutants and various other factors.

In operation, the piston 46 linearly moves between a bottom dead center position (not illustrated) and a top dead center position (as illustrated in FIG. 2), thereby rotating the crankshaft 56 in the process. At bottom dead center, an intake passage 76 couples the combustion chamber 48 to the crankcase chamber 44, allowing air to flow from the crankcase chamber 44 below the piston 46 to the combustion chamber 48 above the piston 46. The piston 46 then moves linearly upward from bottom dead center to top dead center, thereby closing the intake passage 76 and compressing the air into the firing chamber 40. At some point, determined by the control assembly 74, the fuel injection system is engaged to trigger the fuel injector 62, and the ignition assembly is engaged to trigger the spark plug 68. Accordingly, the fuel-air mixture combusts and expands from the firing chamber 40 into the combustion chamber 48, and the piston 46 is forced downwardly toward bottom dead center. This downward motion is conveyed to the crankshaft 56 by the connecting rod 52 to produce a rotational motion of the crankshaft 56, which is then conveyed to the prop 34 by the transmission assembly 24 (as illustrated in FIG. 1). Near bottom dead center, the combusted fuel-air mixture is exhausted from the piston cylinder 42 through an exhaust passage 78. The combustion process then repeats itself as the cylinder is charged by air through the intake passage 76.

Figure 3:
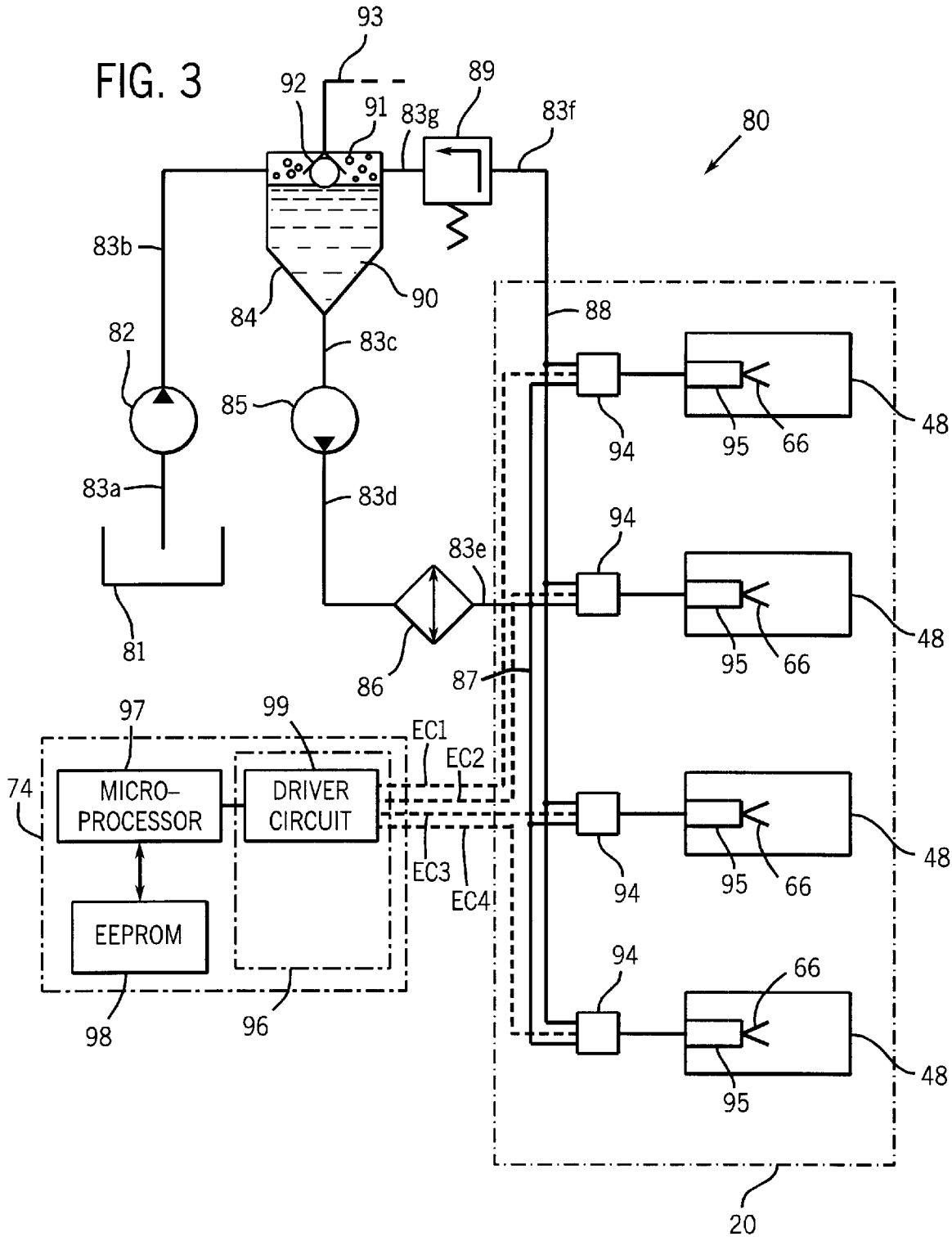
FIG. 3 is a diagrammatical representation of a series of fluid pump assemblies applied to inject fuel into an internal combustion engine.

Referring now to FIG. 3, the fuel injection system 80 is diagrammatically illustrated as having a series of pumps for displacing fuel under pressure in the internal combustion engine 20. While the fluid pumps of the present technique may be employed in a wide variety of settings, they are particularly well suited to fuel injection systems in which relatively small quantities of fuel are pressurized cyclically to inject the fuel into combustion chambers of an engine as a function of the engine demands. The pumps may be employed with individual combustion chambers as in the illustrated embodiment, or may be associated in various ways to pressurize quantities of fuel, as in a fuel rail, feed manifold, and so forth. Even more generally, the present pumping technique may be employed in settings other than fuel injection, such as for displacing fluids under pressure in response to electrical control signals used to energize coils of a drive assembly, as described below. Moreover, the system 80 and engine 20 may be used in any appropriate setting, and are particularly well suited to two-stroke applications such as marine propulsion, outboard motors, motorcycles, scooters, snowmobiles and other vehicles.

In the exemplary embodiment shown in FIG. 3, the fuel injection system 80 has a fuel reservoir 81, such as a tank for containing a reserve of liquid fuel. A first pump 82 draws the fuel from the reservoir 81 through a first fuel line 83*a*, and delivers the fuel through a second fuel line 83*b* to a separator 84. While the system may function adequately without a separator 84, in the illustrated embodiment, separator 84 serves to insure that the fuel injection system downstream receives liquid fuel, as opposed to mixed phase fuel. A second pump 85 draws the liquid fuel from separator 84 through a third fuel line 83*c* and delivers the fuel, through a fourth fuel line 83*d* and further through a cooler 86, to a feed or inlet manifold 87 through a fifth fuel line 83*e*. Cooler 86 may be any suitable type of fluid cooler, including both air and liquid heater exchangers, radiators, and the like.

Fuel from the feed manifold 87 is available for injection into combustion chambers of engine 20, as described more fully below. A return manifold 88 is provided for recirculating fluid not injected into the combustion chambers of the engine. In the illustrated embodiment a pressure regulating valve 89 is coupled to the return manifold 88 through a sixth fuel line 83*f* and is used for maintaining a desired pressure within the return manifold 88. Fluid returned via the pressure regulating valve 89 is recirculated into the separator 84 through a seventh fuel line 83*g* where the fuel collects in liquid phase as illustrated at reference numeral 90. Gaseous phase components of the fuel, designated by referenced numeral 91 in FIG. 3, may rise from the fuel surface and, depending upon the level of liquid fuel within the separator, may be allowed to escape via a float valve 92. The float valve 92 consists of a float that operates a ventilation valve coupled to a ventilation line 93. The ventilation line 93 is provided for permitting the escape of gaseous components, such as for repressurization, recirculation, and so forth. The float rides on the liquid fuel 90 in the separator 84 and regulates the ventilation valve based on the level of the liquid fuel 90 and the presence of vapor in the separator 84.

As illustrated in FIG. 3, engine 20 may include a series of combustion chambers 48 for collectively driving the crankshaft 56 in rotation. As discussed with reference to FIG. 2, the combustion chambers 48 comprise the space adjacent to a series of pistons 46 disposed in piston cylinders 42. As will be appreciated by those skilled in the art, and depending upon the engine design, the pistons 46 (FIG. 2) are driven in a reciprocating fashion within each piston cylinder 42 in response to ignition, combustion and expansion of the fuel-air mixture within each combustion chamber 48. The stroke of the piston within the chamber will permit fresh air for subsequent combustion cycles to be admitted into the chamber, while scavenging combustion products from the chamber. While the present embodiment employs a straightforward two-stroke engine design, the pumps in accordance with the present technique may be adapted for a wide variety of applications and engine designs, including other than two-stroke engines and cycles.

In the illustrated embodiment, the fuel injection system 80 has a reciprocating pump 94 associated with each combustion chamber 48, each pump 94 drawing pressurized fuel from the feed manifold 87, and further pressurizing the fuel for injection into the respective combustion chamber 48. In this exemplary embodiment, the fuel injector 62 (FIG. 2) may have a nozzle 95 (FIG. 3) for atomizing the pressurized fuel downstream of each reciprocating pump 94. While the present technique is not intended to be limited to any particular injection system or injection scheme, in the illustrated embodiment, a pressure pulse created in the liquid fuel forces the fuel spray 66 to be formed at the mouth or outlet of the nozzle 95, for direct, in-cylinder injection. The operation of reciprocating pumps 94 is controlled by an injection controller 96 of the control assembly 74. The injection controller 96, which will typically include a programmed microprocessor or other digital processing circuitry and memory for storing a routine employed in providing control signals to the pumps, applies energizing signals to the pumps to cause their reciprocation in any one of a wide variety of manners as described more fully below.

The control assembly 74 and/or the injection controller 96 may have a processor 97 or other digital processing circuitry, a memory device 98 such as EEPROM for storing a routine employed in providing command signals from the processor 97, and a driver circuit 99 for processing commands or signals from the processor 97. The control assembly 74 and the injection controller 96 may utilize the same processor 97 and memory as illustrated in FIG. 3, or the injection controller 96 may have a separate processor and memory device. The driver circuit 99 may be constructed with multiple circuits or channels, each individual channel corresponding with a reciprocating pump 94. In operation, a command signal may be passed from the processor 97 to the driver circuit 99, which responds by generating separate drive signals for each channel. These signals are carried to each individual pump 94 as represented by individual electric connections EC1, EC2, EC3 and EC4. Each of these connections corresponds with a channel of the driver circuit 99. The operation and logic of the control assembly 74 and injection controller 96 will be discussed in greater detail below.

Figure 4:
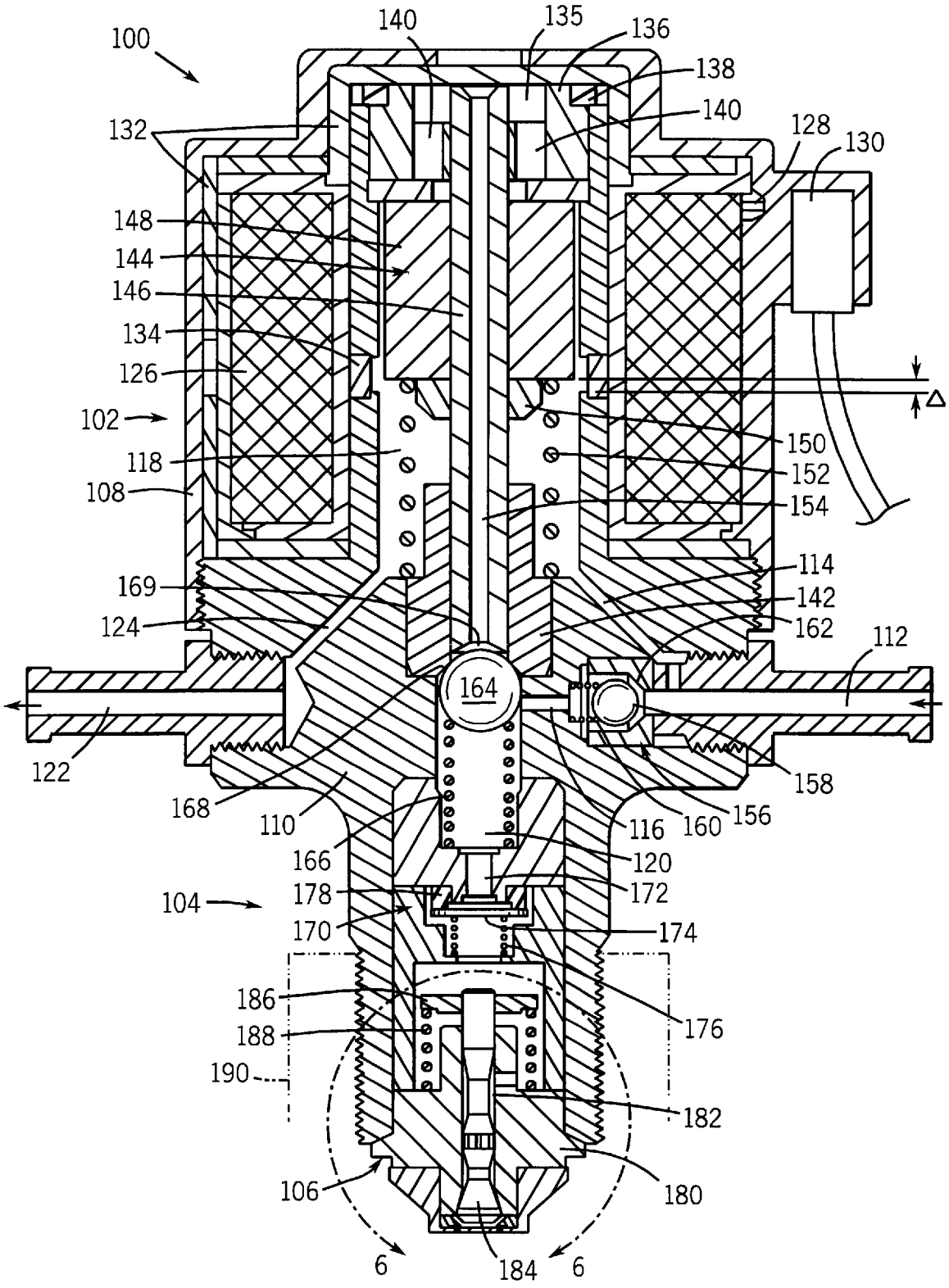
FIG. 4 is a partial cross-sectional view of an exemplary pump in accordance with aspects of the present technique for use in displacing fluid under pressure, such as for fuel injection into a chamber of an internal combustion engine as shown in FIG. 3.
Figure 5:
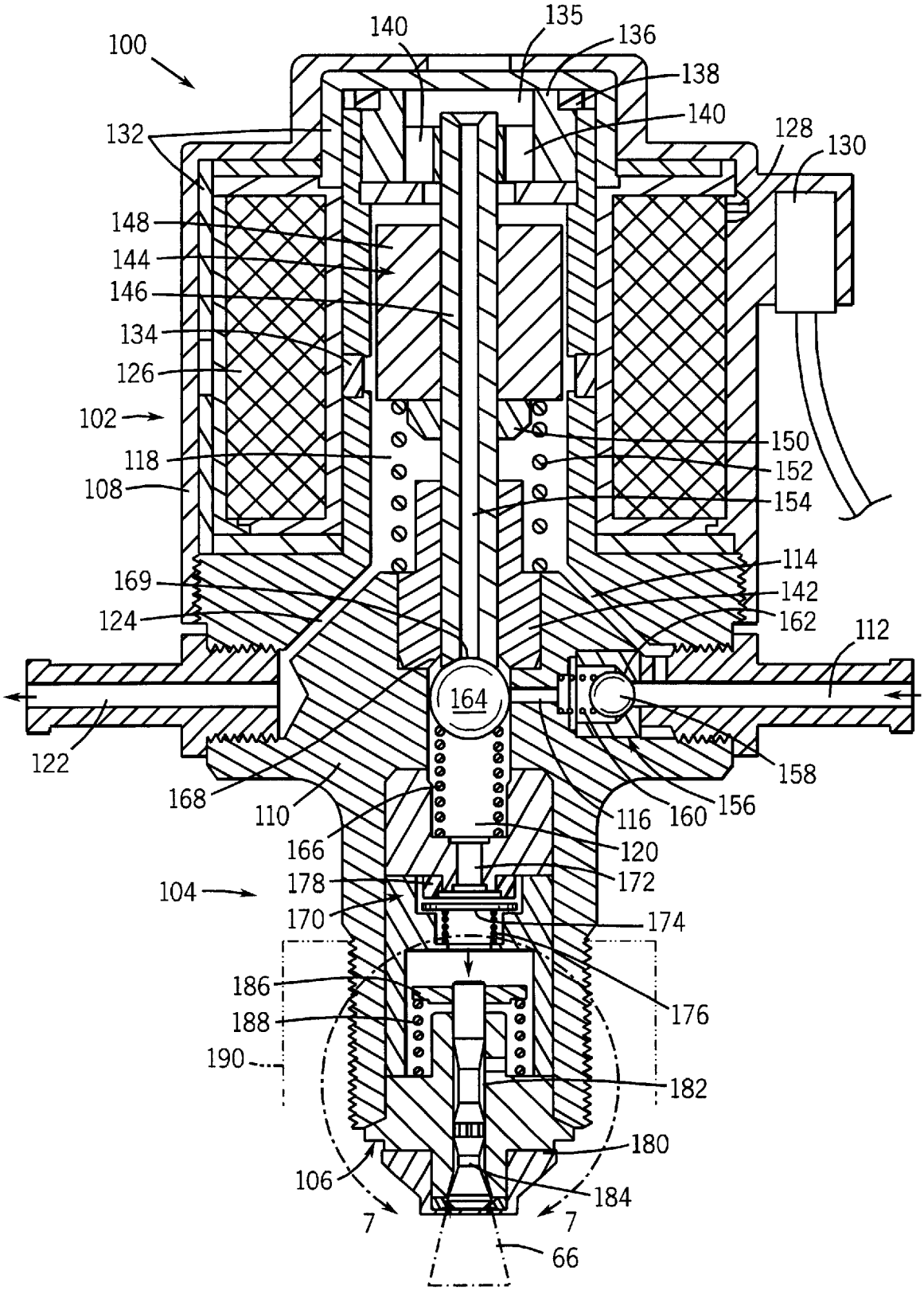
FIG. 5 is a partial cross-sectional view of the pump illustrated in FIG. 4 energized to an open position during a pumping phase of operation.

Specifically, FIG. 4 illustrates the internal components of a pump assembly including a drive section and a pumping section in a first position wherein fuel is introduced into the pump for pressurization. FIG. 5 illustrates the same pump following energization of a solenoid coil to drive a reciprocating assembly and thus cause pressurization of the fuel and its expulsion from the pump. It should be borne in mind that the particular configurations illustrated in FIGS. 4 and 5 are intended to be exemplary only. Other variations on the pump may be envisaged, particularly variants on the components used to pressurize the fluid and to deliver the fluid to a downstream application.

In the presently contemplated embodiment, a pump and nozzle assembly 100, as illustrated in FIGS. 4 and 5, is particularly well suited for application in an internal combustion engine, as illustrated in FIGS. 1–3. Moreover, in the embodiment illustrated in FIGS. 4 and 5, a nozzle assembly is installed directly at an outlet of a pump section, such that the pump 94 and the nozzle 95 of FIG. 3 are incorporated into a single assembly 100. As indicated above, in appropriate applications, the pump 94 may be separated from the nozzle 95, such as for application of fluid under pressure to a manifold, fuel rail, or other downstream component. Thus, the fuel injector 62 described with reference to FIG. 2 may comprise the nozzle 95, the pump and nozzle assembly 100, or other designs and configurations capable of fuel injection.

Referring to FIG. 4, an embodiment is shown wherein the fluid actuators and fuel injectors are combined into a single unit, or pump-nozzle assembly 100. The pump-nozzle assembly 100 is composed of three primary subassemblies: a drive section 102, a pump section 104, and a nozzle 106. The drive section 102 is contained within a solenoid housing 108. A pump housing 110 serves as the base for the pump-nozzle assembly 100. The pump housing 110 is attached to the solenoid housing 108 at one end and to the nozzle 106 at an opposite end.

There are several flow paths for fuel within pump-nozzle assembly 100. Initially, fuel enters the pump-nozzle assembly 100 through the fuel inlet 112. Fuel can flow from the fuel inlet 112 through two flow passages, a first passageway 114 and a second passageway 116. A portion of fuel flows through the first passageway 114 into an armature chamber 118. For pumping, fuel also flows through the second passageway 116 to a pump chamber 120. Heat and vapor bubbles are carried from the armature chamber 118 by fuel flowing to an outlet 122 through a third fluid passageway 124. Fuel then flows from the outlet 122 to the return manifold 88 (see FIG. 3).

The drive section 102 incorporates a linear electric motor. In the illustrated embodiment, the linear electric motor is a reluctance gap device. In the present context, reluctance is the opposition of a magnetic circuit to the establishment or flow of a magnetic flux. A magnetic field and circuit are produced in the motor by electric current flowing through a coil 126. The coil 126 is electrically coupled by leads 128 to a receptacle 130, which is coupled by conductors (not shown) to an injection controller 96 of the control assembly 74. Magnetic flux flows in a magnetic circuit 132 around the exterior of the coil 126 when the coil is energized. The magnetic circuit 132 is composed of a material with a low reluctance, typically a magnetic material, such as ferromagnetic alloy, or other magnetically conductive materials. A gap in the magnetic circuit 132 is formed by a reluctance gap spacer 134 composed of a material with a relatively higher reluctance than the magnetic circuit 132, such as synthetic plastic.

A reciprocating assembly 144 forms the linear moving elements of the reluctance motor. The reciprocating assembly 144 includes a guide tube 146, an armature 148, a centering element 150 and a spring 152. The guide tube 146 is supported at the upper end of travel by the upper bushing 136 and at the lower end of travel by the lower bushing 142. An armature 148 is attached to the guide tube 146. The armature 148 sits atop a biasing spring 152 that opposes the downward motion of the armature 148 and guide tube 146, and maintains the guide tube and armature in an upwardly biased or retracted position. Centering element 150 keeps the spring 152 and armature 148 in proper centered alignment. The guide tube 146 has a central passageway 154, which permits the flow of a small volume of fuel when the guide tube 146 moves a given distance through the armature chamber 118 as described below. Accordingly, the flow of fuel through the central passageway 154 facilitates cooling and acceleration of the guide tube 146, which is moved in response to energizing the coil during operation.

When the coil 126 is energized, the magnetic flux field produced by the coil 126 seeks the path of least reluctance. The armature 148 and the magnetic circuit 132 are composed of a material of relatively low reluctance. The magnetic flux lines will thus extend around coil 126 and through magnetic circuit 132 until the magnetic gap spacer 134 is reached. The magnetic flux lines will then extend to armature 148 and an electromagnetic force will be produced to drive the armature 148 downward towards the reluctance gap spacer 134. When the flow of electric current is removed from the coil by the injection controller 96, the magnetic flux will collapse and the force of spring 152 will drive the armature 148 upwardly and away from alignment with the reluctance gap spacer 134. Cycling the electrical control signals provided to the coil 126 produces a reciprocating linear motion of the armature 148 and guide tube 146 by the upward force of the spring 152 and the downward force produced by the magnetic flux field on the armature 148.

During the return motion of the reciprocating assembly 144 a fluid brake within the pump-nozzle assembly 100 acts to slow the upward motion of the moving portions of the drive section 102. The upper portion of the solenoid housing 108 is shaped to form a recessed cavity 135. An upper bushing 136 separates the recessed cavity 135 from the armature chamber 118 and provides support for the moving elements of the drive section at the upper end of travel. A seal 138 is located between the upper bushing 136 and the solenoid housing 108 to ensure that the only flow of fuel from the armature chamber 118 to and from the recessed cavity 135 is through fluid passages 140 in the upper bushing 136. In operation, the moving portions of the drive section 102 will displace fuel from the armature chamber 118 into the recessed cavity 135 during the period of upward motion. The flow of fuel is restricted through the fluid passageways 140, thus, acting as a brake on upward motion. A lower bushing 142 is included to provide support for the moving elements of the drive section at the lower travel limit and to seal the pump section from the drive section.

While the first fuel flow path 114 provides proper dampening for the reciprocating assembly as well as providing heat transfer benefits, the second fuel flow path 116 provides the fuel for pumping and, ultimately, for combustion. The drive section 102 provides the motive force to drive the pump section 104, which produces a surge of pressure that forces fuel through the nozzle 106. As described above, the drive section 102 operates cyclically to produce a reciprocating linear motion in the guide tube 146. During a charging phase of the cycle, fuel is drawn into the pump section 104. Subsequently, during a discharging phase of the cycle, the pump section 104 pressurizes the fuel and discharges the fuel through the nozzle 106, such as directly into the combustion chamber 48 (see FIG. 3).

During the charging phase fuel enters the pump section 104 from the inlet 112 through an inlet check valve assembly 156. The inlet check valve assembly 156 contains a ball 158 biased by a spring 160 toward a seat 162. During the charging phase the pressure of the fuel in the fuel inlet 112 will overcome the spring force and unseat the ball 158. Fuel will flow around the ball 158 and through the second passageway 116 into the pump chamber 120. During the discharging phase the pressurized fuel in the pump chamber 120 will assist the spring 160 in seating the ball 158, preventing any reverse flow through the inlet check valve assembly 156.

A pressure surge is produced in the pump section 104 when the guide tube 146 drives a pump sealing member 164 into the pump chamber 120. The pump sealing member 164 is held in a biased position by a spring 166 against a stop 168. The force of the spring 166 opposes the motion of the pump sealing member 164 into the pump chamber 120. When the coil 126 is energized to drive the armature 148 towards alignment with the reluctance gap spacer 134, the guide tube 146 is driven towards the pump sealing member 164. There is, initially, a gap 169 between the guide tube 146 and the pump sealing member 164. Until the guide tube 146 transits the gap 169 there is essentially no increase in the fuel pressure within the pump chamber 120, and the guide tube and armature are free to gain momentum by flow of fuel through passageway 154. The acceleration of the guide tube 146 as it transits the gap 169 produces the rapid initial surge in fuel pressure once the guide tube 146 contacts the pump sealing member 164, which seals passageway 154 to pressurize the volume of fuel within the pump chamber 120.

Referring generally to FIG. 5, a seal is formed between the guide tube 146 and the pump sealing member 164 when the guide tube 146 contacts the pump sealing member 164. This seal closes the opening to the central passageway 154 from the pump chamber 120. The electromagnetic force driving the armature 148 and guide tube 146 overcomes the force of springs 152 and 166, and drives the pump sealing member 164 into the pump chamber 120. This extension of the guide tube into the pump chamber 120 causes an increase in fuel pressure in the pump chamber 120 that, in turn, causes the inlet check valve assembly 156 to seat, thus stopping the flow of fuel into the pump chamber 120 and ending the charging phase. The volume of the pump chamber 120 will decrease as the guide tube 146 is driven into the pump chamber 120, further increasing pressure within the pump chamber 120 and forcing displacement of the fuel from the pump chamber 120 to the nozzle 106 through an outlet check valve assembly 170. The fuel displacement will continue as the guide tube 146 is progressively driven into the pump chamber 120.

Pressurized fuel flows from the pump chamber 120 through a passageway 172 to the outlet check valve assembly 170. The outlet check valve assembly 170 includes a valve disc 174, a spring 176 and a seat 178. The spring 176 provides a force to seat the valve disc 174 against the seat 178. Fuel flows through the outlet check valve assembly 170 when the force on the pump chamber side of the valve disc 174 produced by the rise in pressure within the pump chamber 120 is greater than the force placed on the outlet side of the valve disc 174 by the spring 176 and any residual pressure within the nozzle 106.

Figure 6:
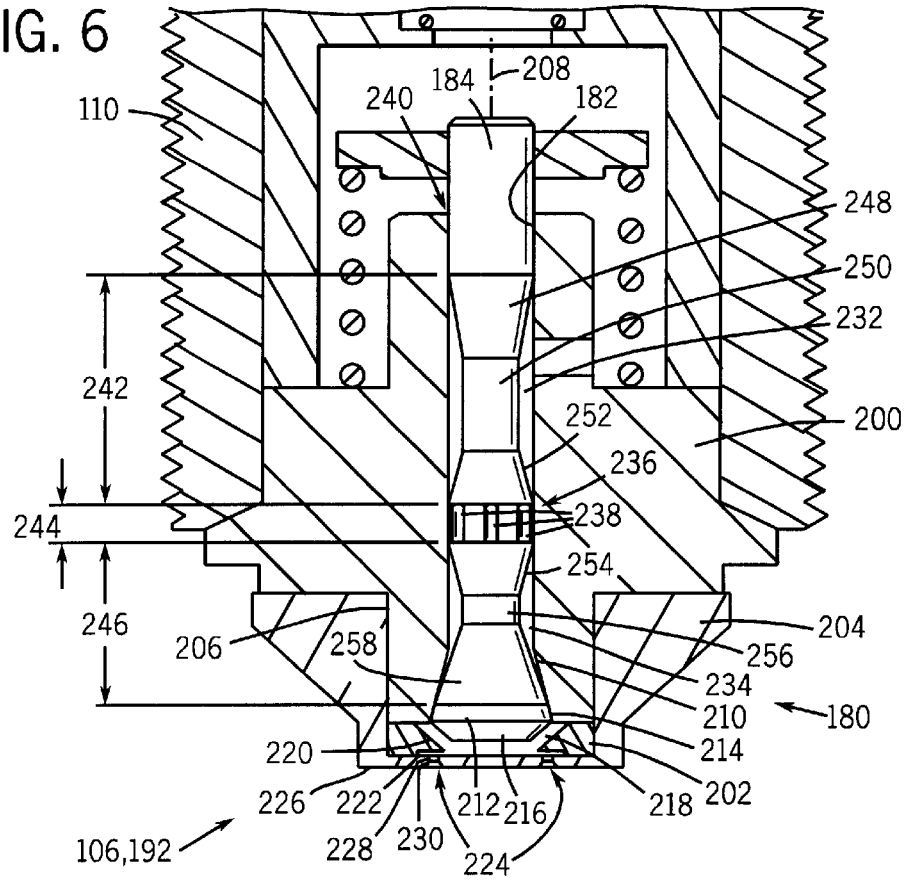
FIG. 6 is a partial cross-sectional view of an exemplary nozzle assembly in a closed position, as illustrated in FIG. 4.
Figure 7:
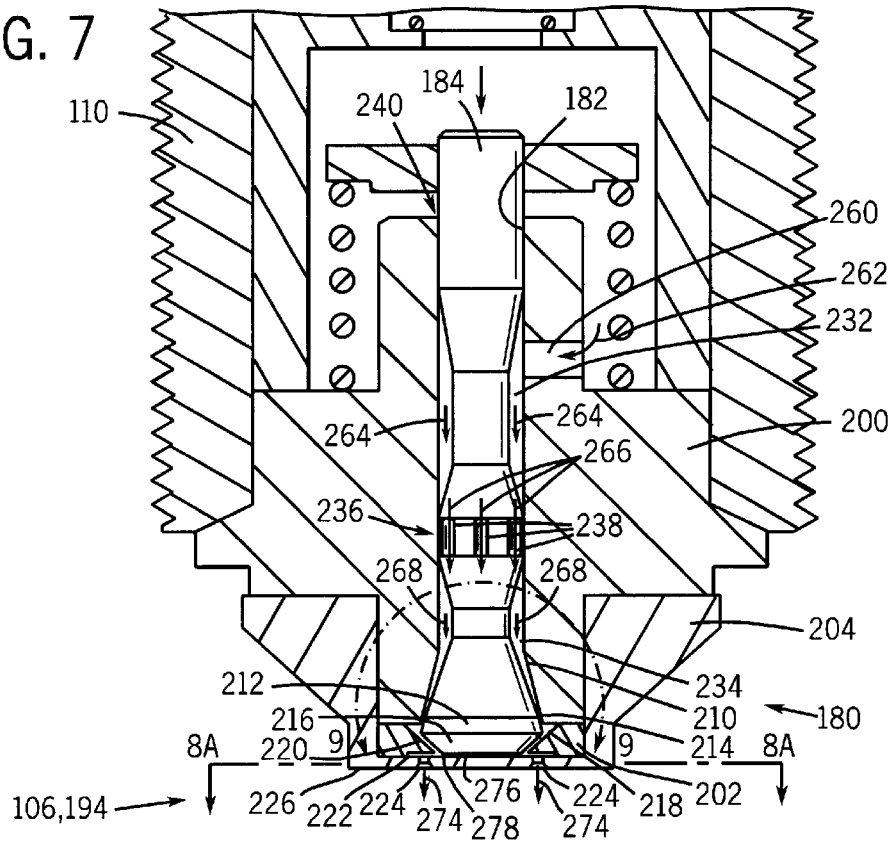
FIG. 7 is a partial cross-sectional view of the nozzle assembly in the open position, as illustrated in FIG. 5.
Figure 9:
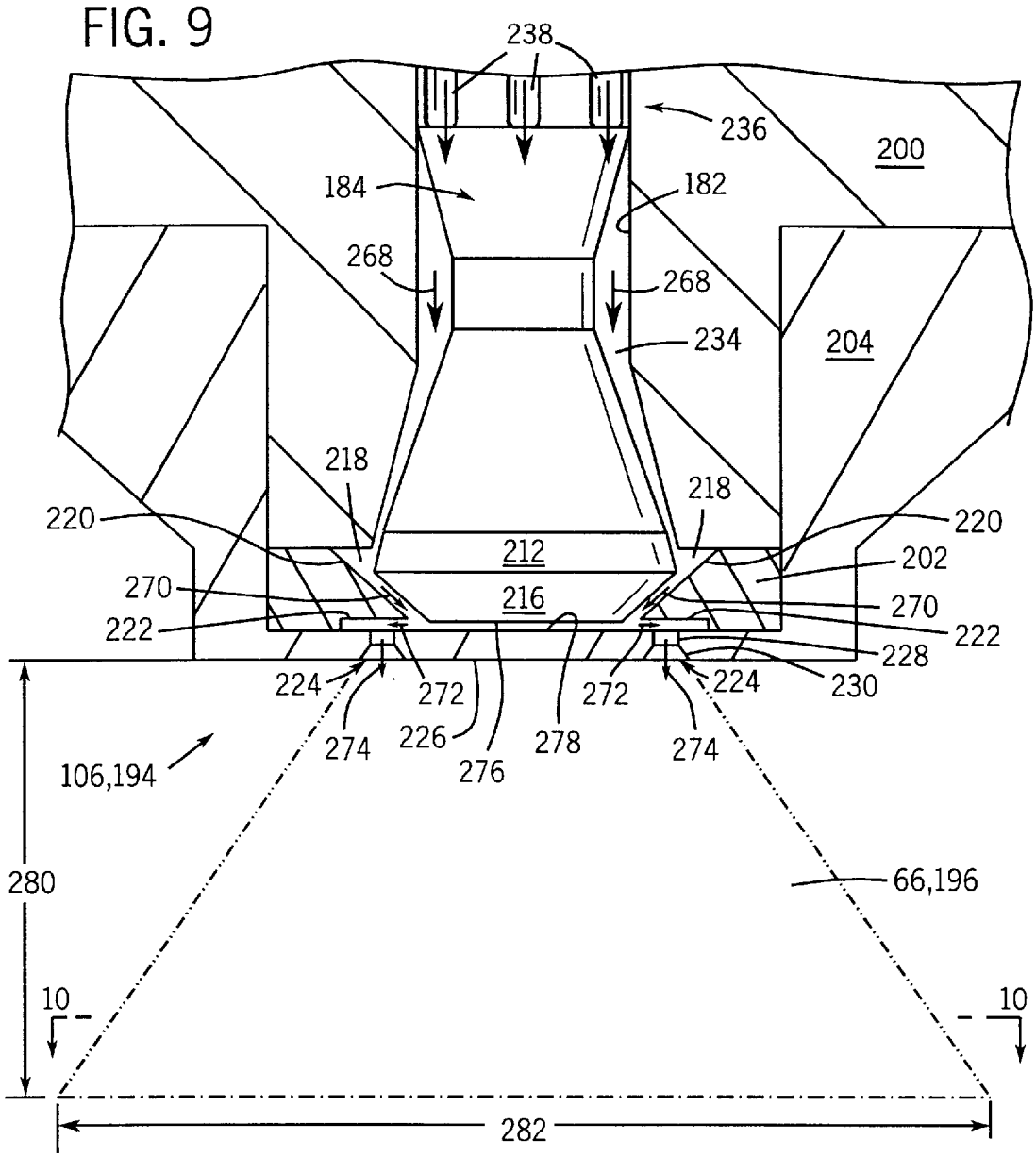
FIG. 9 is a cross-sectional view of an exemplary conical spray formed by the nozzle assembly illustrated in FIGS. 6–8.

Once the pressure in the pump chamber 120 has risen sufficiently to open the outlet check valve assembly 170, fuel will flow from the pump chamber 120 to the nozzle 106. The nozzle 106 is comprised of a nozzle housing 180, a passage 182, a poppet 184, a retainer 186, and a spring 188. The poppet 184 is disposed within the passage 182. The retainer 186 is attached to the poppet 184, and spring 188 applies an upward force on the retainer 186 that acts to hold the poppet 184 seated against the nozzle housing 180. A volume of fuel is retained within the nozzle 106 when the poppet 184 is seated. The pressurized fuel flowing into the nozzle 106 from the outlet check valve assembly 170 pressurizes this retained volume of fuel. The increase in fuel pressure applies a force that unseats the poppet 184. Fuel flows through the opening created between the nozzle housing 180 and the poppet 184 when the poppet 184 is unseated. The fuel is then mixed by a variable flow path defined by a variety of flow enhancement geometries of the poppet 184 and a forward section, such as the inverted cone shape of the poppet 184 and the expanding and contracting flow sections, as illustrated in FIGS. 6, 7 and 9. The fuel then passes through a plurality of ports, which project the fuel as a plurality of fluid jets to form the desired spray pattern (e.g., fuel spray 66, 196). The pump-nozzle assembly 100 may be coupled to a cylinder head 190, such as the head 38 illustrated in FIG. 2, via male/female threads, a flange assembly, or any other suitable mechanical coupling. Thus, the fuel spray from the nozzle 106 may be injected directly into a cylinder.

When the drive signal or current applied to the coil 126 is removed, the drive section 102 will no longer drive the armature 148 towards alignment with the reluctance gap spacer 134, ending the discharging phase and beginning a subsequent charging phase. The spring 152 will reverse the direction of motion of the armature 148 and guide tube 146 away from the reluctance gap spacer 134. Retraction of the guide tube from the pump chamber 120 causes a drop in the pressure within the pump chamber, allowing the outlet check valve assembly 170 to seat. The poppet 184 similarly retracts and seats, and the spray of fuel into the cylinder is interrupted. Following additional retraction of the guide tube, the inlet check valve assembly 156 will unseat and fuel will flow into the pump chamber 120 from the inlet 112. Thus, the operating cycle the pump-nozzle assembly 100 returns to the condition shown in FIG. 4.

A detailed illustration of the nozzle 106 is provided in FIGS. 6–10. In FIGS. 6, 7 and 9, cross-sectional side views of the nozzle 106 are provided to illustrate exemplary geometries and fluid flows through the nozzle 106. Front views of the nozzle 106 are provided in FIGS. 8A and 8B to illustrate various multi-port configurations of the nozzle 106. As illustrated in FIG. 9, these multiple ports are configured to project multiple fluid jets from the nozzle 106 in a generally conic spray pattern, which may eventually form a substantially uniform solid spray downstream of the nozzle 106. For example, the cross-section of the conic spray pattern may have a generally uniform droplet distribution or a plurality of distinct groups of droplets corresponding to the multiple ports/jets, as illustrated in detail by FIGS. 10 and 11. In FIG. 6, the nozzle 106 is illustrated in a closed configuration 192. In FIGS. 7 and 9, the nozzle 106 is illustrated in an open configuration 194 to facilitate fluid flow through the nozzle 106 and out through the multiple ports to form the generally conic spray, which may have multiple distinct spray patterns or an intermixed spray pattern (e.g., a substantially uniform solid spray). As discussed in detail below, the geometry and configuration of the nozzle 106 enhances the fluid flow and spray characteristics of the nozzle 106.

As illustrated in FIG. 6, the nozzle 106 has the poppet 184 movably disposed in the passage 182 of the nozzle housing 180. The nozzle housing 180 comprises a core section 200, a forward inner section 202 disposed adjacent the core section 200, and a forward outer section 204 disposed about the forward inner section 202 and a forward portion 206 of the core section 200. Within the nozzle 106, a plurality of fluid flow passages are formed between the foregoing sections to enhance the fluid flow and spray characteristics. These fluid flow passages maybe symmetrically arranged about a longitudinal centerline, or they may have a symmetrical cross-section, such as a ring-shaped cross-section. As illustrated, the passage 182 extends along a centerline 208 of the core section 200. The passage 182 has a uniform cross section, such as a cylindrical cross section, which extends along the centerline 208 to an expanding section 210 (e.g., a conical section) of the core section 200 adjacent the forward inner section 202. The poppet 184 has a seat portion 212, which is seated against a seat portion 214 in the expanding section 210 adjacent the forward inner section 202. The poppet 184 also has a contracting section 216, which extends into a front cavity 218 formed by a contracting section 220 and expanding section 222 (e.g., a ring-shaped or washer-shaped section) of the forward inner section 202. The expanding section 222 extends into a set of ports 224, which may be symmetrically disposed about a front section 226 of the forward outer section 204. As illustrated, the set of ports 224 have a cylindrical passage 228 followed by an expanding passage 230 to facilitate a desired fluid dispersion from the nozzle 106. It should also be noted that the set of ports 224 may comprise any one or a combination of contracting, expanding and cylindrical passages to facilitate the desired fluid dispersion from the nozzle 106. For example, if the set of ports 224 comprise a diverging/expanding passage, then the fluid jets projecting from the set of ports 224 have a spray projection angle or spread that generally increases with the angle and length of the diverging/expanding passage.

In the closed configuration 192 illustrated in FIG. 6, the poppet 184 is seated against the core section 200 at the seat portions 212 and 214 to prevent fluid flow into the front cavity 218 and out through the set of ports 224. However, when the pressure has risen sufficiently in the pump chamber 120 to open the outlet check valve assembly 170, fluid flows through the passage 182 about the poppet 184 to unseat the seat portion 212 of the poppet 184 from the seat portion 214 of the core section 200. Accordingly, fluid flows through the front cavity 218 and disperses through the set of ports 224, as illustrated in the open configuration 194 of FIGS. 7 and 9.

As illustrated in FIG. 6, the geometry of the poppet 184 and the passage 182 forms a rear cavity 232 and a forward cavity 234, which are disposed about a guide area 236. A set of passages 238 is disposed about the guide area 236 between the surface of the poppet 184 and the passage 182.

The rear cavity 232 is disposed near a rear 240 of the poppet 184 and the passage 182, while the forward cavity 234 is disposed adjacent the seat portions 212 and 214. In this exemplary embodiment of the nozzle 106, the rear cavity 232 has a length 242, the guide area 236 has a length 244, and the forward cavity 234 has a length 246. These lengths 242, 244, and 246 may have any suitable dimensions, such as in a conventional nozzle assembly. However, the lengths 242, 244 and 246 may be adapted to increase or decrease the turbulence (i.e., decrease or increase the flow uniformity) of the fluid flowing through the passage 182 adjacent the front cavity 218 and the set of ports 224.

The rear cavity 232 has a contracting section 248 near the rear 240, followed by a central section 250 and an expanding section 252. As illustrated, the central section 250 comprises a cylindrical geometry, while the contracting and expanding sections 248 and 252 have conic geometries. The guide area 236, which is disposed adjacent the expanding section 252, has the set of passages 238 symmetrically disposed about the poppet 184. These passages 238 may comprise a curved or linear geometry in any number and configuration to allow fluid to pass through the guide area 236. In the forward cavity 234, the poppet 184 has a contracting section 254 adjacent the guide area 236, followed by a central section 256 and an expanding section 258. As illustrated, the central section 256 comprises a cylindrical geometry, while the contracting and expanding sections 254 and 258 have conic geometries. The particular geometries of these sections 248, 250, 252, 254, 256 and 258 also can be adapted to induce a desired fluid flow through the passage 182.

The geometry of the forward inner section 202 and the front portion 226 of the forward outer section 204 are configured to facilitate desired fluid flow characteristics, such as turbulence, mixing and high velocities, prior to dispersion through the set of ports 224. Accordingly, the enhanced fluid flow caused by the contracting section 220, the expanding section 222 and the ports 224 may provide a distinct multi-jet spray, a relatively uniform solid spray, or a semi-mixed spray composed of the multiple jets projecting from the multiple ports. The particular geometrical pattern, density and features of this spray also may vary with axial distance from the nozzle 106. The foregoing configuration of the forward inner section and ports 224 also may affect the size and distribution of droplet sizes throughout the spray. Accordingly, the forward inner section 202 and ports 224 may have any suitable geometry to facilitate mixing and desirable flow qualities. For example, the forward inner section 202 may have a relatively jagged or zigzagging flow path to increase turbulence. The jaggedness (i.e., degree of angles) of the zigzagging flow path also controls the degree of turbulence in the fluid flow. Sharper angles tend to increase the turbulence. As illustrated, the contracting and expanding sections 220 and 222 of the forward inner section 202 have conic and disk-shaped geometries, respectively, which induce turbulence and mixing in the fluid flow. The ports 224 also may have any suitable geometry and position relative to the contracting and expanding sections 220 and 222 to retain the turbulent effects of the forward inner section 202 and to enhance the dispersion of fluid as it exits the nozzle 106. For example, the ports 224 may be positioned relatively closer to the abrupt angle between the contracting and expanding sections 220 and 222 to retain the turbulence in the fluid flowing through the ports 224.

In FIG. 7, exemplary fluid flows are illustrated for the nozzle 106 in the open configuration 194, which is triggered by a sufficient pressure increase in the pump chamber 120 to open the outlet check valve assembly 170. Fluid is then fed into the passage 182 through an inlet 260, which extends through the core section 200 and into the rear cavity 232. As illustrated in FIGS. 7 and 9, the fluid passes through the nozzle 106 as indicated by arrows 262, 264, 266, 268, 270, 272, and 274, which correspond to flow through the inlet 260, the rear cavity 232, the set of passages 238 disposed about the guide area 236, the forward cavity 234, the contracting section 220 of the front cavity 218, the expanding section 222 of the front cavity 218, and through the set of ports 224. As illustrated in this open configuration 194, a front face 276 of the poppet 184 is disposed adjacent an inner surface 278 of the forward outer section 204. As the poppet 184 is opened outwardly toward the forward outer section 204, the nozzle 106 forms contracting, and expanding (e.g., zigzagging) passages, which have a ring-shaped cross-section. Accordingly, the fluid flows inwardly at an angle according to the arrows 270 and then outwardly in the expanding section 222 according to the arrows 272. The fluid then flows forward through the ports 224 and disperses according to the arrows 274. As discussed above, this zigzagging flow pattern through the front cavity 218 facilitates mixing and turbulence in the fluid flow. The geometry of the ports 224 also affects the turbulence levels and the characteristics of spray 196, as illustrated in FIG. 9. For example, the ports 224 may embody cylindrical passages, diverging or converging conical passages, or any suitable combination of uniform or varying cross-sections. The ports 224 also may embody angular passageways, which enhance or direct the fluid flowing through the nozzle 106. Accordingly, the angular or zigzagging passageways through the forward inner section 202 and the geometry of the ports 224 facilitate desired fluid flow and spray characteristics (e.g., atomization, droplet dispersion, mixing and uniformity, etc.).

Figure 8A:
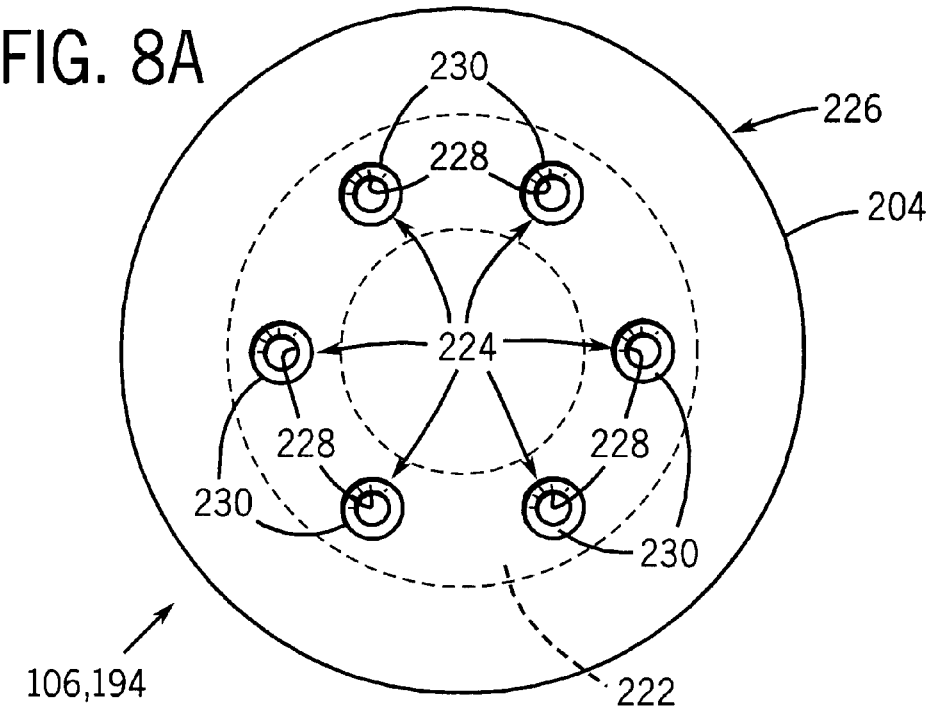
FIGS. 8A and B are front views of the nozzle assembly illustrated in FIGS. 6–7 illustrating exemplary port configurations for spray formation.
Figure 8B:
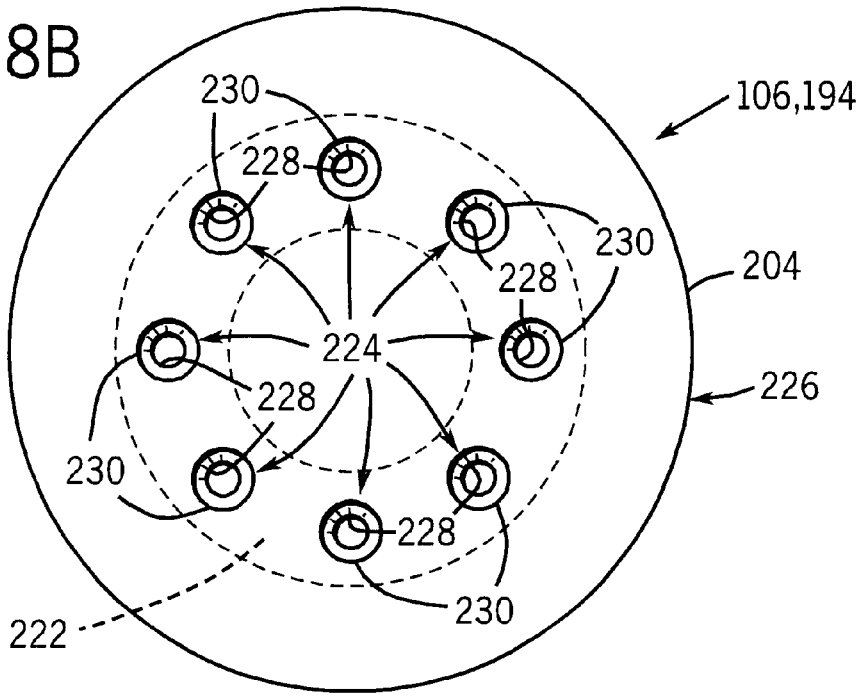

The front 226 of the forward outer section 204 is illustrated in further detail in FIGS. 8A and 8B, which are cross sections of the front 226 illustrating exemplary patterns of the ports 224. As discussed above, the front 226 may have any suitable number of the ports 224, such as six or eight ports, as illustrated in FIGS. 8A and 8B, respectively. It also should be noted that the set of ports 224 are arranged symmetrically about the centerline 208 in the front 226. However, any other suitable geometry of the forward inner section 202 and arrangement of the ports 224 is within the scope of the present technique. The ports 224 may include axially uniform and varying geometries, which may be formed by drilling, punching, molding or any suitable manufacturing process.

As illustrated by the dashed lines, the ports 224 are symmetrically arranged within the expanding section 222 of the front cavity 218. Depending on the desired flow volume and characteristics, the ports 224 may have any suitable passage geometry of uniform or varying cross-section, such as one or a combination of a cylindrical passage, an expanding passage, and a contracting passage. For example, as discussed above, the angle and length of the foregoing uniform and varying cross-sections may be varied to control the crosswise and lengthwise penetration of jets projecting from the ports 224. A cylindrical geometry may provide a narrow jet, which has a relatively narrow crosswise penetration and a relatively long lengthwise penetration. An expanding geometry may provide a broader jet, which has a relatively broader crosswise penetration and a relatively shorter lengthwise penetration. If the port has a combination of uniform and varying cross-sections, then the effects of each section would increase with their relative lengths. As illustrated in FIGS. 8A and 8B, the ports 224 have cylindrical passages 228 and expanding passages 230. If the lengths of the expanding passages 230 are increased relative to the cylindrical passages 228, then the ports 224 may provide fluid jets having relatively broader crosswise penetration and shallower lengthwise penetration. The ports 224 also may be disposed at angles to direct the fluid flow or facilitate intermixing of the jets projecting from the ports 224. For example, the ports 224 may be directed toward a desired target in a combustion chamber offset from the nozzle 106. The ports also may have various curved or linear cross sections to facilitate other desired flow properties and spray characteristics.

Figure 10:
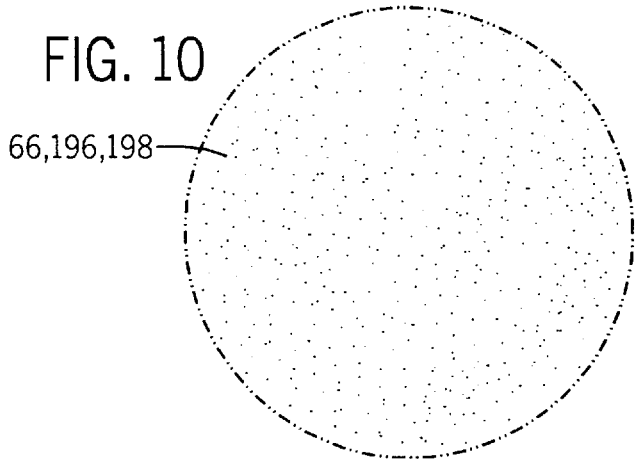
FIG. 10 is a cross-sectional view of the conical spray having a substantially solid or uniform distribution of droplets.
Figure 11:
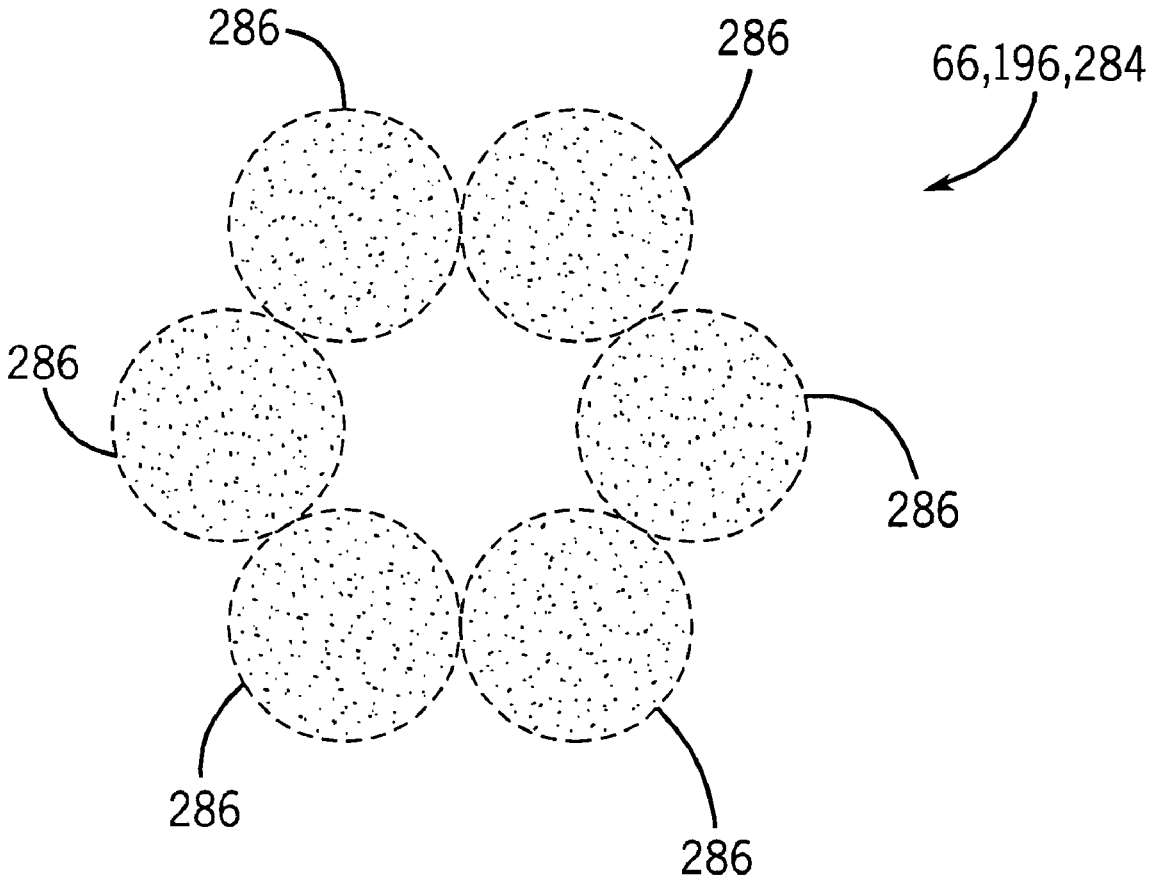
FIG. 11 is a cross-sectional view of the conical spray having a multi-group distribution of droplets.

As illustrated in FIG. 9, the nozzle 106 forms the spray 196 from the set of ports 224. The spray 196 has a relatively uniform droplet distribution attributed to the geometries and flow patterns within the nozzle 106. At a downstream distance 280 from the nozzle 106, the spray 196 has a width 282 that may be controlled by the geometries of the forward inner section 202 and the ports 224. For example, based on the distance 280 and the foregoing geometries, the spray 196 may have a substantially uniform cross section 198 or a multi-group cross-section 284 having a plurality of distinct droplet groups 286, as illustrated in FIGS. 10 and 11, respectively. The width 282 and corresponding cross sections 198 and 284 may be further enhanced by varying the zigzagging geometries in the forward inner section 202 and the uniform and varying passages through the front 226, as discussed above. For example, if the ports 224 have cylindrical passages (e.g., cylindrical passages 228) extending through the front 226, then the width 282 may be relatively narrower than a solid spray formed by expanding passages (e.g., expanding passages 230). Accordingly, the present technique may utilize a variety of geometries for the poppet 184, the forward inner section 202, and the front 226 of the forward outer section 204 (e.g., ports 224) to facilitate desired flow and spray characteristics in this outwardly (or forward) opening poppet configuration.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A nozzle comprising:

an outwardly opening poppet disposed in a conduit, comprising:

a fluid passage section; and a head section removably seated against a forward portion of the conduit; and a spray formation assembly disposed adjacent the forward portion, comprising:

a flow enhancement passage comprising a contracting passage and an expanding passage; and a plurality of ports coupled to the flow enhancement passage.

2. The nozzle of claim 1, wherein the fluid passage section comprises a ring-shaped passage formed between the outwardly opening poppet and the conduit.

3. The nozzle of claim 1, wherein the fluid passage section comprises rear and forward sections, which form rear and forward cavities between the outwardly opening poppet and the conduit.

4. The nozzle of claim 2, wherein the fluid passage section comprises a guide section disposed between the rear and forward sections, the guide section having at least one passageway coupling the rear and forward cavities.

5. The nozzle of claim 1, wherein the head section comprises an expanding section.

6. The nozzle of claim 5, wherein the head section comprises a contracting section.

7. The nozzle of claim 6, wherein the expanding and contracting sections comprise conical geometries.

8. The nozzle of claim 1, wherein the spray formation assembly is configured to provide a substantially uniform distribution of fluid droplets from the plurality of ports.

9. The nozzle of claim 8, wherein the spray formation assembly is configured to provide a conical spray pattern.

10. The nozzle of claim 9, wherein the flow enhancement passage comprises a ring-shaped cross-section.

11. The nozzle of claim 10, wherein the contracting passage comprises a conical geometry.

12. The nozzle of claim 10, wherein the expanding passage comprises a washer-shaped geometry.

13. The nozzle of claim 10, wherein the outwardly opening poppet is movable between seated and unseated orientations, the unseated orientation forming a ring-shaped passage between the forward portion and the head section.

14. The nozzle of claim 13, wherein a front face of the head section abuts an inner face of the spray formation assembly in the unseated orientation of the outwardly opening poppet.

15. The nozzle of claim 1, wherein the plurality of ports comprises a passage geometry configured to provide a desired fluid dispersion.

16. The nozzle of claim 15, wherein the passage geometry comprises a cylindrical section.

17. The nozzle of claim 15, wherein the passage geometry comprises a conical section.

18. The nozzle of claim 1, comprising a spring assembly coupled to the outwardly opening poppet for biasing the head section inwardly toward the forward portion.

19. The nozzle of claim 1, comprising a fuel supply coupled to the fluid passage section.

20. A spray system, comprising:

a nozzle assembly comprising:

an outwardly opening poppet movably disposed between seated and unseated positions in a conduit; and a flow enhancement assembly disposed forward the outwardly opening poppet, wherein the flow enhancement assembly comprises converging and diverging ring-shaped passages.

21. The spray system of claim 20, comprising a fluid supply assembly coupled to the nozzle assembly.

22. The spray system of claim 21, wherein the fluid supply assembly comprises a pump assembly.

23. The spray system of claim 22, wherein the fluid supply assembly comprises a reciprocating drive assembly coupled to the pump assembly.

24. The spray system of claim 22, comprising a timing assembly coupled to the pump assembly, wherein the timing assembly is configured to coordinate fuel injection by the nozzle assembly with ignition by an ignition assembly.

25. The spray system of claim 20, wherein the nozzle assembly comprises a spring assembly coupled to the outwardly opening poppet for biasing the outwardly opening poppet inwardly toward the seated position.

26. The spray system of claim 20, wherein the outwardly opening poppet comprises rear and forward sections, which form rear and forward cavities between the outwardly opening poppet and the conduit.

27. The spray system of claim 26, wherein the outwardly opening poppet comprises a guide section disposed between the rear and forward sections, the guide section having at least one passageway coupling the rear and forward cavities.

28. The spray system of claim 20, wherein the outwardly opening poppet comprises a head section having a conical geometry.

29. The spray system of claim 28, wherein the conical geometry comprises converging and diverging sections.

30. The spray system of claim 20, wherein a ring-shaped passage is formed between the conduit and the outwardly opening poppet in the unseated position.

31. The spray system of claim 30, wherein a front face of the outwardly opening poppet abuts an inner face of the flow enhancement assembly in the unseated position of the outwardly opening poppet.

32. The spray system of claim 20, wherein the flow enhancement assembly comprises a plurality of ports coupled to the converging and diverging ring-shaped passages.

33. The spray system of claim 32, wherein the plurality of ports comprises a passage geometry configured to provide a desired fluid dispersion from each of the plurality of ports.

34. The spray system of claim 33, wherein the plurality of ports are configured for collectively forming a conical spray pattern having a substantially uniform distribution of droplets through a cross-section of the conical spray pattern.

35. The spray system of claim 20, wherein at least one of the converging and diverging ring-shaped passages comprises a conical geometry.

36. The spray system of claim 35, wherein at least one of the converging and diverging ring-shaped passages comprises a washer-shaped geometry.

37. A combustion engine, comprising:

a combustion chamber;

an ignition assembly coupled to the combustion chamber;

a spray assembly coupled to the combustion chamber, comprising:

an outwardly opening flow controller disposed in a conduit; and a forward flow assembly disposed adjacent the outwardly opening flow controller, wherein the forward flow assembly comprises converging and diverging passages; and a fuel delivery assembly coupled to the spray assembly.

38. The combustion engine of claim 37, wherein the outwardly opening flow controller comprises a poppet movably disposed between seated and unseated positions in the conduit.

39. The combustion engine of claim 37, wherein the outwardly opening flow controller comprises rear and forward sections, which form rear and forward cavities between the outwardly opening flow controller and the conduit.

40. The combustion engine of claim 39, wherein the outwardly opening flow controller comprises a guide section disposed between the rear and forward sections, the guide section having at least one passageway coupling the rear and forward cavities.

41. The combustion engine of claim 37, wherein a ring-shaped passage is formed between the conduit and the outwardly opening flow controller in the unseated position.

42. The combustion engine of claim 37, wherein the forward flow assembly comprises a plurality of ports coupled to the converging and diverging passages.

43. The combustion engine of claim 42, wherein the converging and diverging passages have a ring-shaped cross-section.

44. The combustion engine of claim 37, wherein the fuel delivery assembly comprises a pump assembly.

45. The combustion engine of claim 44, wherein the fuel delivery assembly comprises a reciprocating drive assembly coupled to the pump assembly.

46. The combustion engine of claim 44, comprising a timing assembly coupled to the spray assembly and the ignition assembly, wherein the timing assembly is configured to coordinate fuel injection by the spray assembly with ignition by the ignition assembly.

47. A method for forming a spray from an outwardly opening nozzle assembly, comprising:

passing fluid through a flow enhancement assembly forward an outwardly opening poppet disposed in a fluid conduit, the flow enhancement assembly comprising converging and diverging passages having a ring-shaped cross-section; and passing the fluid through a plurality of ports coupled to the flow enhancement assembly.

48. The method of claim 47, wherein passing the fluid through the flow enhancement assembly comprises passing the fluid through a conical-shaped passage geometry.

49. The method of claim 48, wherein passing the fluid through the flow enhancement assembly comprises passing the fluid through a washer-shaped passage geometry.

50. The method of claim 49, wherein passing the fluid through the flow enhancement assembly comprises inletting the fluid to the converging and diverging passages from a ring-shaped passage formed between the outwardly opening poppet and the fluid conduit in an unseated position.

51. The method of claim 50, wherein inletting the fluid comprises passing the fluid through the fluid conduit about a depressed portion of the outwardly opening poppet.

52. The method of claim 51, wherein passing the fluid through the fluid conduit comprises passing the fluid through a guide section formed between forward and rear depressed portions of the outwardly opening poppet.

53. The method of claim 50, wherein inletting the fluid comprises reciprocally driving a head portion of the outwardly opening poppet out of a seated position and springably returning the head portion back into the seated position.

54. The method of claim 47, wherein passing the fluid through the flow enhancement assembly comprises mixing the fluid through a conical-shaped converging passage and a washer-shaped diverging section.

55. The method of claim 54, comprising pumping the fluid into the fluid conduit.

56. The method of claim 55, comprising spraying the fluid from the plurality of ports into a combustion chamber.

57. The method of claim 56, comprising temporally coordinating a spray pulse of the fluid with an ignition pulse to ignite the fluid within the combustion chamber.

58. A method of forming a spray assembly, comprising:

providing an outwardly opening nozzle assembly; and coupling a spray enhancement assembly to an exit of the outwardly opening nozzle assembly, the spray enhancement assembly comprising converging and diverging passages and a plurality of spray formation ports.

59. The method of claim 58, wherein providing the outwardly opening nozzle assembly comprises movably disposing a poppet in a fluid conduit, and forming a ring-shaped passage between the fluid conduit and the poppet in an unseated position relative to the fluid conduit.

60. The method of claim 59, comprising coupling a spring assembly to the poppet to bias the poppet inwardly toward a seated position relative to the fluid conduit.

61. The method of claim 58, comprising coupling a pump assembly to the fluid conduit.

62. The method of claim 58, wherein coupling the spray enhancement assembly to the exit comprises forming the converging and diverging passages symmetrically about a longitudinal axis of the outwardly opening nozzle assembly.

63. The method of claim 62, wherein the converging and diverging passages comprise a ring-shaped cross-section.

64. The method of claim 62, comprising orienting the plurality of spray formation ports in a ring-shaped pattern.

65. The method of claim 62, comprising forming a passage geometry in the plurality of ports to provide a desired dispersion of fluid.

66. The method of claim 65, wherein forming the passage geometry comprises forming a conical passage section having a desired dispersion angle.

* * * * *